US007467925B2

(12) United States Patent
Schröder

(10) Patent No.: US 7,467,925 B2
(45) Date of Patent: Dec. 23, 2008

(54) SECURING DEVICE FOR A MOVING BLADE OF A TURBOMACHINE

(75) Inventor: Peter Schröder, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 494 days.

(21) Appl. No.: 11/186,736

(22) Filed: Jul. 21, 2005

(65) Prior Publication Data

US 2006/0018756 A1 Jan. 26, 2006

(30) Foreign Application Priority Data

Jul. 22, 2004 (EP) ..... 04017390

(51) Int. Cl.
*F01D 5/32* (2006.01)

(52) U.S. Cl. ..... 416/220 R; 29/889.1; 29/889.21

(58) Field of Classification Search ..... 416/219 R, 416/220 R, 221, 248; 29/889.1, 889.21, 29/889.22

See application file for complete search history.

(56) References Cited

U.S. PATENT DOCUMENTS

| | | | | |
|---|---|---|---|---|
| 2,963,271 A | | 12/1960 | McCormick | |
| 3,039,740 A | | 6/1962 | Hockert | |
| 3,165,294 A | * | 1/1965 | Anderson | 416/220 R |
| 5,713,721 A | * | 2/1998 | Glynn et al. | 416/220 R |
| 6,358,001 B1 | | 3/2002 | Bosel et al. | |

FOREIGN PATENT DOCUMENTS

| | | | |
|---|---|---|---|
| DE | 33 41 871 | C2 | 5/1985 |
| DE | 101 20 532 | A1 | 10/2002 |
| FR | 976 790 | | 3/1951 |
| JP | 37-9356 | | 11/1935 |
| JP | 57151005 | A | 9/1982 |
| JP | 01069702 | A | 3/1989 |
| JP | 2002047902 | A | 2/2002 |

* cited by examiner

*Primary Examiner*—Christopher Verdier

(57) ABSTRACT

A securing device for a moving blade of a turbomachine, the moving blade being arranged on a rotatable rotor disk, in which securing device the rotor disk has on its outer circumference, for receiving the blade root of each moving blade, in each case a transversely running holding groove which is shaped correspondingly to the blade root and in the groove bottom of which a blind hole with a securing element is provided, which securing element can be introduced into a centering bore arranged in the blade root and located opposite the blind hole.

19 Claims, 4 Drawing Sheets

SECURING DEVICE FOR A MOVING BLADE OF A TURBOMACHINE

CROSS REFERENCE TO RELATED APPLICATIONS

This application claims priority of European application No. 04017390.8 EP filed Jul. 22, 2004, which is incorporated by reference herein in its entirety

FIELD OF INVENTION

The invention relates to a securing device for a moving blade of a turbomachine, said moving blade being arranged on a rotatable rotor disk, in which securing device the rotor disk has on its outer circumference, for receiving the blade root of each moving blade, in each case a holding groove which is shaped correspondingly to the blade root and in the groove bottom of which in each case a blind hole with a securing element is provided, which securing element projects into a centering bore arranged in the blade root and located opposite the blind hole, for securing the moving blade. Furthermore, the invention relates to a turbomachine with a rotor disk and with a moving blade arranged on the latter and to a method for mounting and demounting a moving blade of a turbomachine with an abovementioned securing device.

BACKGROUND OF INVENTION

DE 33 41 871 C2 discloses a securing device for the guide vane ring of an axial compressor. The securing device comprises a bore in the groove bottom of the holding groove, in which a carrier ring segment carries the guide vanes. A spring-mounted holding pin is provided in the bore. The holding pin engages into a second bore arranged in the carrier ring segment and thus prevents the displacement of the carrier ring segment along the holding groove. Furthermore, in the radial end face of the guide vane root, two radially running blind hole bores are provided, in which are arranged helical springs which are supported on the carrier ring segment and thus press the guide vanes radially inward.

A similar device for fastening a moving blade along a circumferential groove running within a rotor of an axial-throughflow turbomachine is shown in DE 101 20 532 A1.

However, vibration occurring during the transport of the compressor may desecure the blades. Owing to the pulse-like shock occurring in this case, the holding pins may overcome the prestress of the spring, so that the blades may be displaced. Furthermore, during operation, high temperatures may arise in the compressor which are detrimental to the elasticity of the spring. This may lead, under continuous action, to the failure of the spring. Particularly when the securing device is arranged in the rotor, further loads brought about by centrifugal forces occur during operation and may adversely influence the useful life of the spring.

It is likewise known for the blade root of a moving blade to be deformed plastically by means of a corking operation, so that a projection obtained thereby is hooked as an axial securing device together with the rotor disk.

This has the particular disadvantage that the moving blade is connected to the rotor disk releasably to only a limited extent. Although the moving blade can be released again as a result of the removal of the projection, for example by grinding, the moving blade nevertheless cannot then be reused. At the same time, during the grinding of the moving blade, care must be taken to ensure that no chips fall into the turbomachine.

Moreover, the clamping of moving blades in the holding groove by means of disposable securing plates is known.

SUMMARY OF INVENTION

An object of the invention is, therefore, to provide a more reliable, more long-lasting and re-releasable securing device which can withstand the thermal and mechanical loads occurring during the operation of the turbomachine. A further object of the invention is to specify a turbomachine with such a securing device and a method for mounting and demounting a moving blade on a turbomachine with such a securing device.

The first mentioned object is achieved by means of the features of the claims, and the object directed at the turbomachine is achieved by means of the features of the claims. Furthermore, the object directed at the method for mounting a moving blade is achieved by means of the features of the claims and the object directed at the demounting method is achieved by means of the features of the claims.

According to the solution, a thread is formed in the blind hole and the securing element is designed as a securing screw countersinkable in the latter, and a recess in the region of the blind hole is provided as axial access for a tool for rotating the securing screw.

The invention, in this context, is based on the idea that, instead of the spring, a securing screw is used as a releasable element for securing the moving blade. The elastic spring is therefore relinquished, which keeps the holding pin pushed in the centering bore, with its spring force being applied. The securing screw, because of its solid construction, can withstand the thermal and mechanical loads more simply than the elastic spring. Moreover, the securing screw with thread leads to a reduction in the components, since the securing screw at the same time assumes the task of positioning the spring and also the safety bolt action of the holding pin.

The displacement of the securing element between a mounting position and an operating position, said displacement being necessary for mounting and securing the moving blade, no longer takes place as a result of the tensioning and detensioning of the spring, but, instead, as a result of the rotation of the securing screw. Unwanted desecuring, as in the prior art, is therefore possible only with difficulty, if not even impossible.

By the spring being dispensed with, a more reliable and more load-bearing securing device for a moving blade is provided. Moreover, the invention presents a releasable securing device, in which the moving blade employed and also the securing element employed can be reused.

Despite the moving blade being mounted, the securing screw is in this case accessible for a tool through a recess provided in the region of the blind hole. For this purpose, the tool is applied through the recess to the securing screw transversely to the longitudinal extent of the latter, so that the securing of the moving blade can be effected and released simply and quickly.

Advantageous embodiments are specified in the dependent claims.

In an advantageous embodiment, the blind hole is designed as a threaded bore which can be produced simply and cost-effectively by means of a cutting operation.

In an alternative embodiment, the blind hole has arranged in it an insert with a thread, said insert being secured against rotation in the blind hole. By virtue of the threaded insert, notches and also notching stresses can be avoided in the rotor disk, as a result of which the useful life of the rotor disk is not adversely influenced. Even if damage possibly occurs on the thread, the insert can be exchanged. This increases the servicing friendliness during maintenance work.

The recess which allows access to the securing screw from the end face of the rotor disk may advantageously be provided either in the rotor disk and/or in the blade root. Owing to the lateral, that is to say axial, approach or access, there is no need for any additional structural changes in the turbomachine.

In an advantageous embodiment, the securing screw has radially running bores which are distributed on the circumference and into which a lever bar can be inserted as a rotating tool. The securing screw can thus be screwed into the blind hole and, after the attachment of the moving blade, can be screwed out of the blind hole and into the centering bore by means of the lever bar.

In an alternative embodiment, the securing screw has on its outer circumference, in the region accessible through the recess, a hexagon for a hexagon wrench serving as a tool for rotating the securing screw. Thus, instead of the lever bar, a conventional tool may be used for rotating the securing screw.

If the securing screw is designed in the manner of a grub screw, when the securing screw is being screwed into the blind hole it can be screwed in particularly quickly by means of a corresponding screwdriver.

Preferably, in addition to the securing action in the axial direction, a desired axial position of the moving blade is also simultaneously brought about if the diameter of the centering bore narrows conically toward its bottom and the securing screw has a screw head shaped correspondingly thereto. By virtue of the conical shape of the centering bore and of the screw head, during the operation of unscrewing the securing screw and screwing it into the centering orifice the moving blade is corrected into the desired and predetermined axial position.

For mounting a moving blade on a rotor disk of a turbomachine, the securing screw is screwed into the blind hole until its screw head lies radially further inward than the groove bottom of the holding groove. Subsequently, the moving blade is pushed into the holding groove until its centering bore is aligned with the blind hole so that subsequently, with the aid of the tool for rotating the securing screw, it is rotated from the blind hole and screwed into the centering bore. For demounting, the steps are carried out in reverse order with opposite directions given.

BRIEF DESCRIPTION OF THE DRAWINGS

The invention is explained with reference to a drawing in which.

DETAILED DESCRIPTION OF INVENTION

Figure 1:
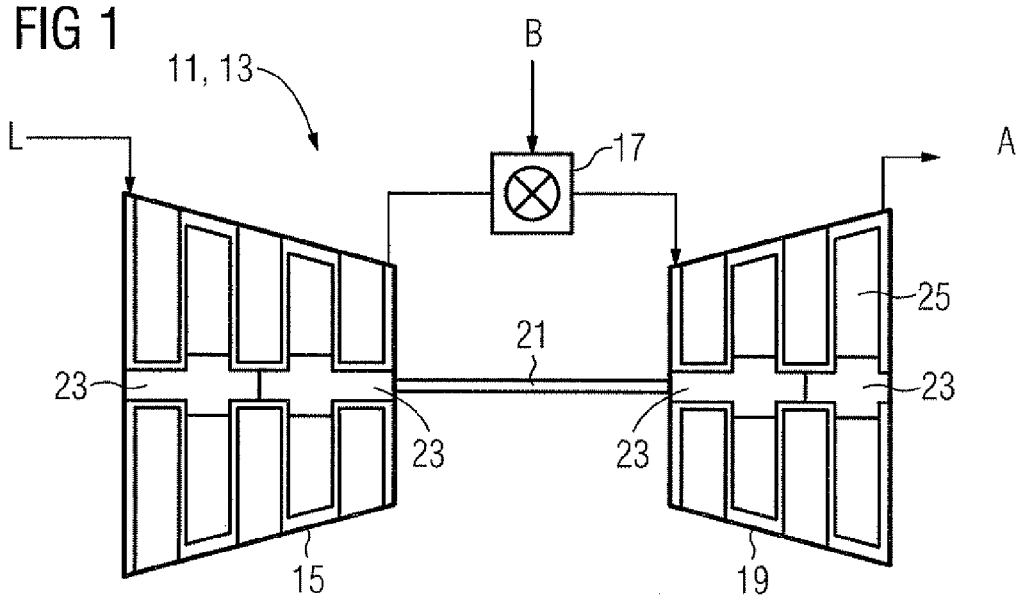
FIG. 1 shows a diagrammatic gas turbine in a sectional view.

Turbomachines, such as gas turbines and compressors, and their types of operation are generally known. FIG. 1 shows a turbomachine 11 which is designed as a gas turbine 13. For this purpose, the gas turbine 13 has a compressor 15, a combustion chamber 17 and a turbine unit 19. Furthermore, the gas turbine 13 comprises a rotor 21. The rotor 21 is composed, both in the compressor 15 and in the turbine unit 19, of a plurality of axially adjacent rotor disks 23, on the outer circumference of which moving blades 25 are arranged in each case in a ring.

Figure 2:
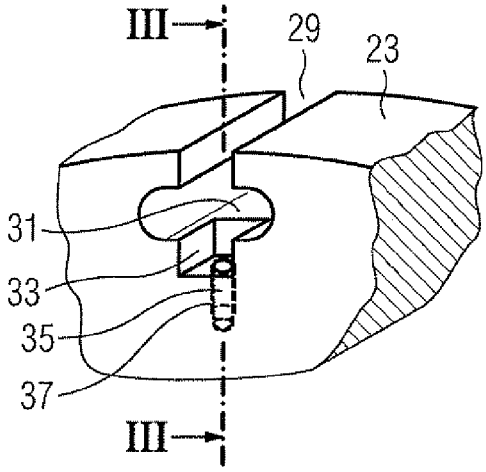
FIG. 2 shows a perspective view of a detail of a rotor disk.

When the gas turbine 13 is in operation, air is sucked in by the compressor 15 and compressed. The compressed air is supplied to the combustion chamber 17, mixed with a fuel B and burnt at this point to form a hot gas. The hot gas flows into the turbine unit 19 and expands at the moving blades 25 of the turbine unit 19 so as to perform work. The rotor 21 of the gas turbine 13 is at the same time driven. FIG. 2 shows a perspective illustration of a detail of the rotor disk 23. On the outer circumference of the rotor disk 23, a transversely running holding groove 29 is illustrated, into which a moving blade 25 can be pushed with a blade root designed correspondingly to the holding groove 29. For the sake of clarity, only one of the holding grooves 29 distributed on the circumference for the moving blades 25 of a ring is shown in the rotor disk 23. In the groove bottom 31 of each holding groove 29 is provided a recess 33, from which runs a blind hole 35 extending radially inward into the rotor disk 23.

Figure 3:
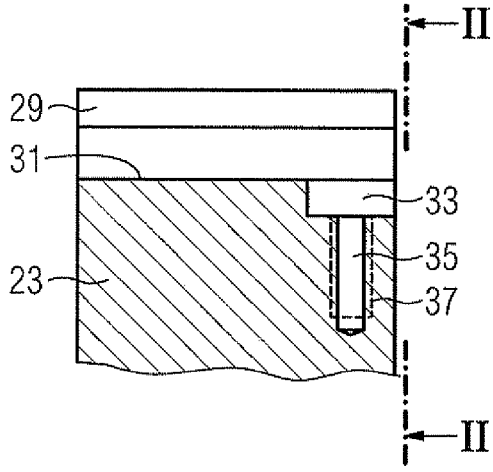
FIG. 3 shows a sectional view of a rotor disk according to FIG. 2.

The section III-III through the rotor disk 23 of FIG. 2 is shown in FIG. 3, wherein FIG. 2 shows a perspective illustration of a detail of the rotor disk 23 according to line II-II. The recess 33, from which the blind hole 35 extends in the radial direction, is arranged radially within the groove bottom 31. In this case, the blind hole 35 has at least partially a thread 37.

Figure 4:
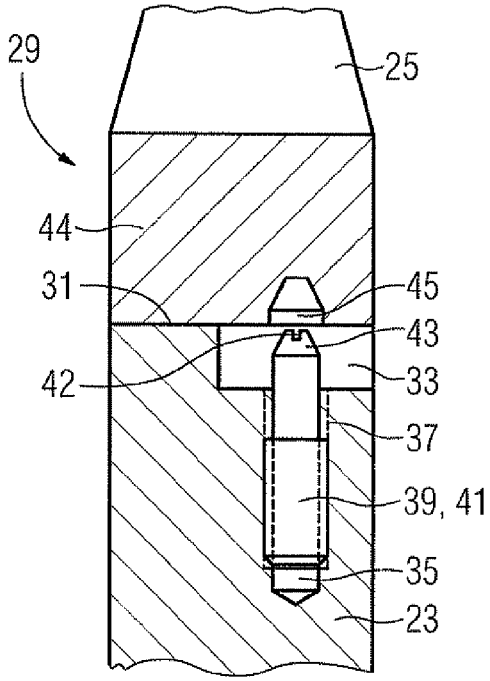
FIG. 4 shows the rotor disk with a securing screw and with a moving blade.

FIG. 4 shows a section through the rotor disk 23 with a securing element 39 already screwed in the blind hole 35 and with an inserted moving blade 25. The securing element 39 is in this case not yet screwed into a centering bore 45 of the moving blade 25, said centering bore being arranged in the blade root 44.

The diameter of the centering bore 45 resembling a blind hole, which is provided in the blade root 44, first remains constant and subsequently decreases conically toward the bore bottom.

Similarly to this, the securing screw 41 has a corresponding conical screw head 43.

For mounting the moving blade 25, first the securing element 39, designed as a securing screw 41, is screwed into the blind hole 35, until the screw head 43 of the securing screw 41 lies radially further inward than the groove bottom 31 of the holding groove 29 or lies radially further inward than the orifice of the centering bore 45 when the moving blade 25 is pushed in. For this purpose, the securing screw 41 has on its end face a slot 42 in the manner of a grub screw, so that the securing screw 41 can be screwed into the thread 37 particularly simply and quickly by means of a screwdriver.

Figure 5A:
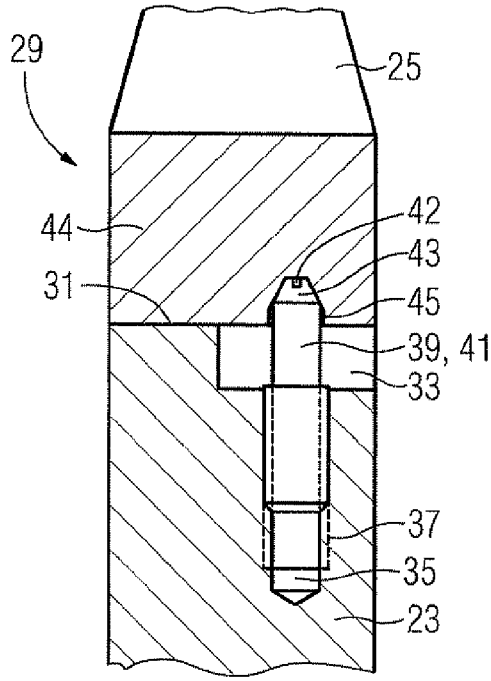
FIG. 5*a* shows the rotor disk with the moving blade secured by means of the securing screw, with the recess formed in the rotor disk.
Figure 5B:
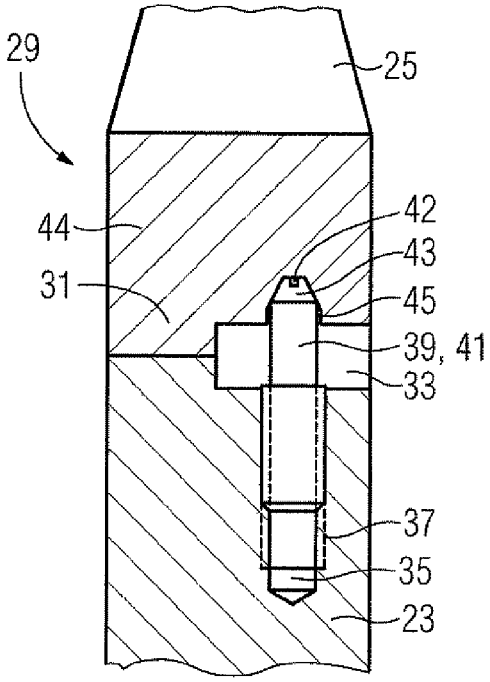
FIG. 5*b* shows the rotor disk with the moving blade secured by means of the securing screw, with the recess formed in the rotor disk and blade root.
Figure 5C:
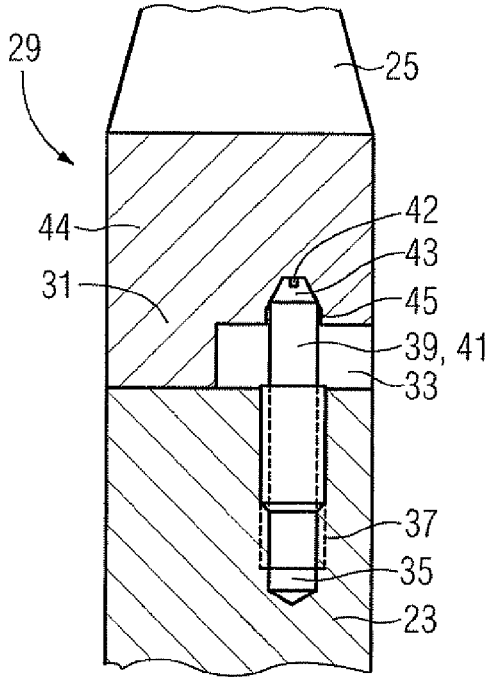
FIG. 5*c* shows the rotor disk with the moving blade secured by means of the securing screw, with the recess formed in the blade root.

Subsequently, the moving blade 25 is pushed with its blade root 44 into the holding groove 29, until the radially extending centering bore 45 lies opposite and in alignment with the blind hole 35. Subsequently, by means of a tool which can be introduced laterally through the recess 33 lying radially between the blind hole 35 and the centering bore 45, the securing screw 41 is screwed out of the blind hole 35 and into the centering bore 45, until, to complete the securing device 50, either its screw head 43 comes to lie on the bottom of the centering bore 45 or the conical surfaces of the centering bore 45 and screw head 43 lie against one another (FIG. 5). In this operating position, the moving blade 25 is secured against axial displacement. At the same time, the securing screw 41 presses the moving blade 25 radially outward into a defined radial position.

By virtue of the corresponding conical shapes of the centering bore 45 and of the screw head 43, the moving blade 25 is forced into a desired defined axial position.

Figure 6:
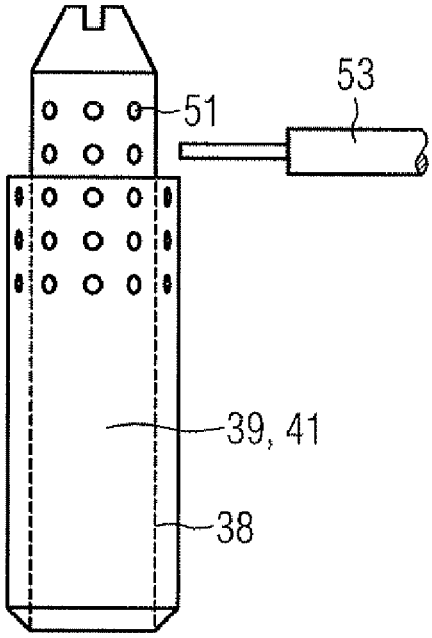
FIG. 6 shows a securing screw with radially running bores.

FIG. 6 shows a securing screw 41 provided with radial bores 51 which are distributed over the circumference in the upper region. A lever bar 53 can be inserted as a tool into these bores 51 and the securing screw 41 can be rotated in the thread 37 by means of said lever bar. In the lower region of the securing screw 41, a thread 38 is provided, which can be screwed together with the thread 37.

Figure 7:
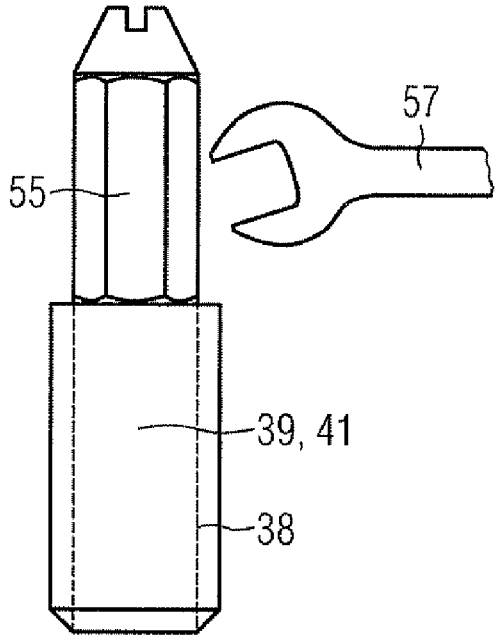
FIG. 7 shows a securing screw with a hexagon.

FIG. 7 shows an alternative embodiment of the securing screw 41 which in the upper region has, instead of the bores 51, a hexagon 55 to which a hexagon wrench 57 corresponding to it can be applied in order to rotate the securing screw 41.

Instead of the embodiment shown, the recess 33 required for a tool to have access to the securing screw 41 on the end face may also be provided partially or completely in the blade root 44 of the moving blade 25.

Figure 8:
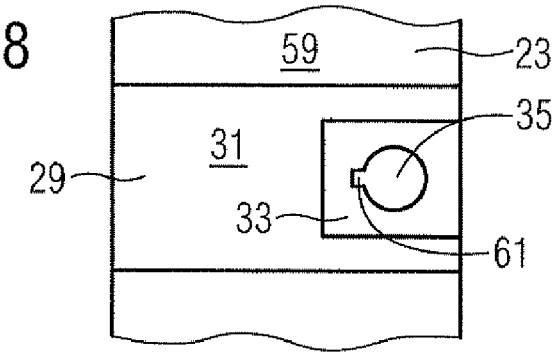
FIG. 8 shows a rotor disk with an insert having a thread.

In an alternative embodiment, FIG. 8 shows the circumferential surface 59 of the rotor disk 23 with a holding groove 29 for a moving blade 25 having the blind hole 35. The blind hole 35 has in its circumferential surface, instead of the thread, at least one securing groove 61 running along the bore direction.

Figure 9:
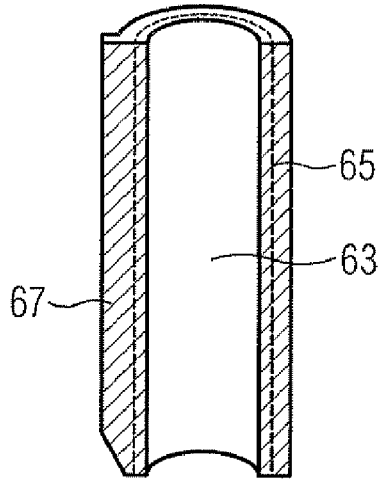
FIG. 9 shows an insert with a thread and with an antirotation device.

An insert 63, illustrated in FIG. 9, can be inserted into the blind hole 35. The insert 63 is designed, correspondingly to the blind hole 35, in the manner of an essentially circular sleeve and has an internal thread 65, into which the securing screw 41 can be screwed. Moreover, the insert 63 has on its outer circumference at least one projection 67 which runs in its axial direction and which is designed correspondingly to the securing groove 61.

Figure 10:
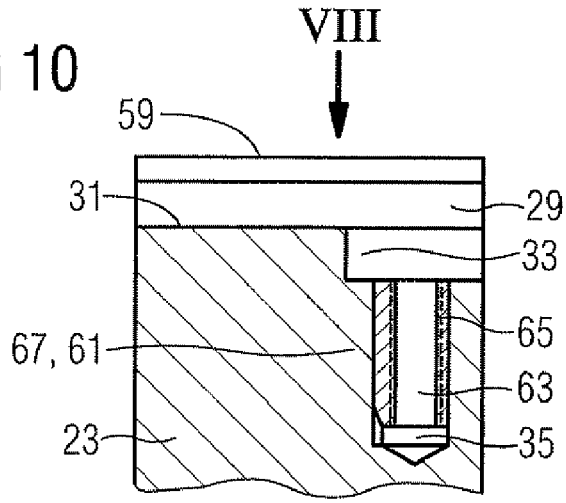
FIG. 10 shows the insert inserted in the rotor disk.

The insert 63 inserted into the blind hole 35 is shown in FIG. 10, the projection 67 engaging into the securing groove 61 which thus forms the means for securing the insert 63 against rotation in the blind hole 35. Alternatively, in each case two or more projections 67 and securing grooves 61 could also be provided.

The invention claimed is:

1. A securing device for a moving blade of a turbomachine, the moving blade having a blade root, comprising:

a first blind hole, wherein the first blind hole is a centering bore within the blade root;

a rotatable rotor disk having a holding groove for receiving the blade root, the holding groove shaped to mate with the blade root;

a second blind hole provided in the holding groove, the second blind hole having a thread; and a securing element for securing the moving blade, the securing element adapted to be countersunk into the second blind hole and to project into the centering bore.

2. The device as claimed in claim 1, wherein the second blind hole is a threaded bore.

3. The device as claimed in claim 1, wherein a recess in a region of the second blind hole provides access to the securing element, wherein the rotor disk and the blade root are facing the recess.

4. The device as claimed in claim 3, wherein the recess is provided in a recess area selected from the group consisting of the rotor disk, the blade root and combinations thereof.

5. The device as claimed in claim 3, wherein the securing element has a hexagon for applying a hexagon wrench for rotating the securing element, the hexagon located in the region accessible through the recess.

6. The device as claimed in claim 1, wherein the securing element has a bore adapted for an insertion of a lever bar, the lever bar for rotating the securing element.

7. The device as claimed in claim 6, wherein a plurality of bores are distributed around the outer circumference of the securing element.

8. The device as claimed in claim 1, wherein the securing element is a securing screw.

9. The device as claimed in claim 8, wherein the securing screw is a grub screw.

10. The device as claimed in claim 1, wherein the turbomachine is a gas turbine.

11. A method for mounting a moving blade on a rotor disk of a turbomachine with a securing device, the moving blade having a blade root and the rotor disk having a holding groove for receiving the blade root, comprising:

providing a first blind hole, wherein the first blind hole is a centering bore within the blade root;

screwing a securing screw into a second blind hole, the second blind hole having a thread and located within the rotor disk;

placing the blade root into the holding grove;

aligning the centering bore within the blade root with the second blind hole; and rotating the securing screw into the centering bore via a tool.

12. The method as claimed in claim 11, wherein the centering bore narrows conically toward a bottom and the securing screw has a screw head shaped to mate with the centering bore.

13. The method as claimed in claim 11, wherein the tool is a lever bar or a wrench.

14. The method as claimed in claim 11, wherein the turbomachine is a gas turbine.

15. The method as claimed in claim 11, wherein the securing screw is accessable via a recess in a region of the second blind hole.

16. A method for demounting a moving blade from a rotor disk of a turbomachine with a securing device, the moving blade having a blade root and the rotor disk having a holding groove for receiving the blade root, comprising:

providing a first blind hole, wherein the first blind hole is a centering bore within the blade root;

providing a recess in a region of a second blind hole for accessing a securing screw, the second blind hole within the rotor disk;

rotating the securing screw via a tool, the securing screw rotated from the centering bore within the blade root to the second blind hole; and removing the movable blade from the holding groove.

17. The method as claimed in claim 16, further comprising unscrewing the securing screw from the second blind hole.

18. The method as claimed in claim 16, wherein the centering bore narrows conically toward its bottom and the securing screw has a screw head shaped to mate with the centering bore.

19. The method as claimed in claim 16, wherein the tool is a lever bar or a wrench.

* * * * *